United States Patent [19]

Loofbourrow et al.

[11] Patent Number: 4,656,840

[45] Date of Patent: Apr. 14, 1987

[54] CONTAINER FOR FREEZABLE LIQUID

[75] Inventors: James G. Loofbourrow, Corona del Mar; William E. Lewis, San Pedro; Robert J. Pelton, Nevada City, all of Calif.

[73] Assignee: Gott Corporation, Winfield, Kans.

[21] Appl. No.: 802,735

[22] Filed: Nov. 29, 1985

[51] Int. Cl.[4] ..... F25D 3/08

[52] U.S. Cl. ..... 62/530; 62/457; 215/10; 220/23.4

[58] Field of Search ..... 62/457, 530; 215/10; 220/23.4; 206/504; 446/125

[56] References Cited

U.S. PATENT DOCUMENTS

| | | | |
|---|---|---|---|
| 2,652,698 | 9/1953 | Schlumbohm | 62/457 X |
| 3,374,917 | 3/1968 | Troy | 215/10 X |
| 3,703,816 | 11/1972 | Weathers | 62/457 |
| 4,311,022 | 1/1982 | Hall | 62/457 |
| 4,341,091 | 7/1982 | Minter | 62/457 X |
| 4,393,975 | 7/1983 | Moore | 62/457 X |
| 4,545,487 | 10/1985 | Asmus | 220/23.6 X |

FOREIGN PATENT DOCUMENTS

| | | | |
|---|---|---|---|
| 1031675 | 6/1953 | France | 62/530 |

*Primary Examiner*—Lloyd L. King

*Attorney, Agent, or Firm*—Kokjer, Kircher, Bradley, Wharton, Bowman & Johnson

[57] ABSTRACT

A container filled with a freezable liquid for use in refrigerating or temporarily cooling purposes. The container of the invention is generally rectangular and has two plugs each on its face and one side. Opposite these plugs and in contra position to the plugs, on the back and other side of the container, are corresponding recesses. The recesses and plugs are formed in order that the plugs of one container fit into the recesses of a like container, thus allowing the containers to be fastened together. Thus, when filled with freezable liquid and frozen, two or more containers may be connected, at either their sides or face-to-back, to form blocks of frozen containers. In addition to the advantages of using containers filled with freezable liquid over using water-ice as a coolant, which advantages have been found in the prior art, use of blocks of the frozen containers of the present invention provides longer lasting cooling capability and the convenience of the cooling medium being adaptable to the size and shape of the cooling compartment.

1 Claim, 5 Drawing Figures

Fig. 1.
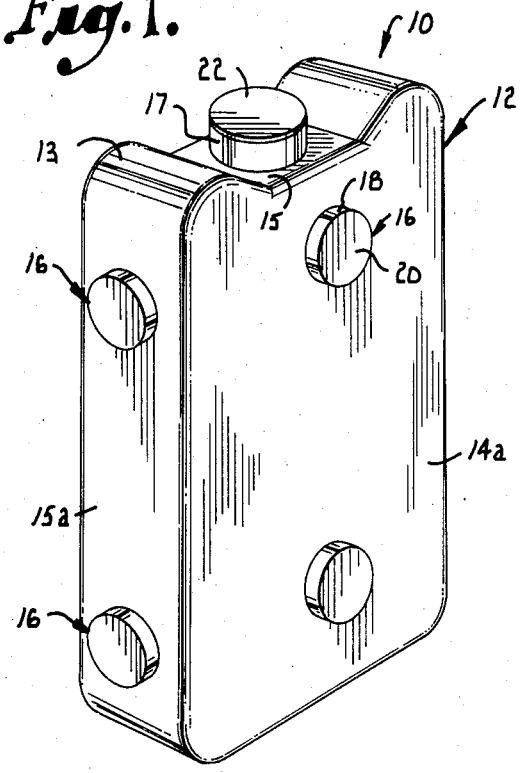
Fig. 2.
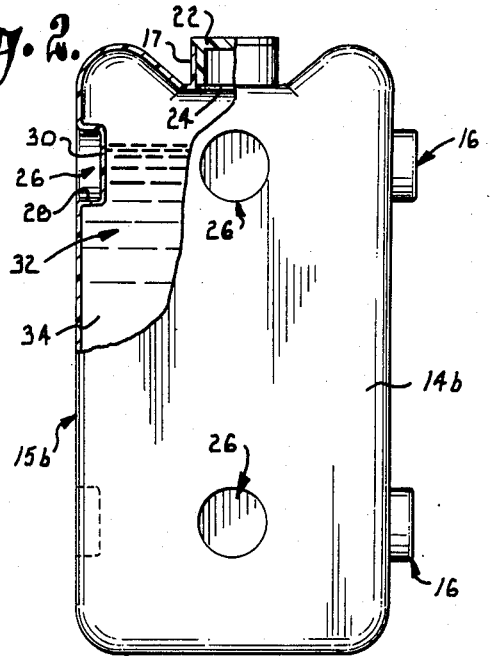
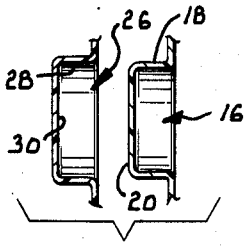
Fig. 5.
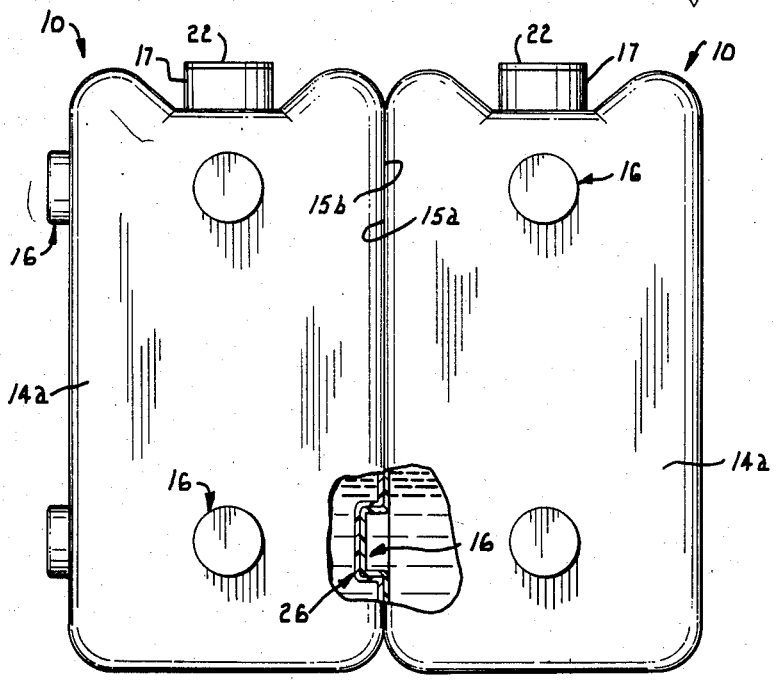
Fig. 3.
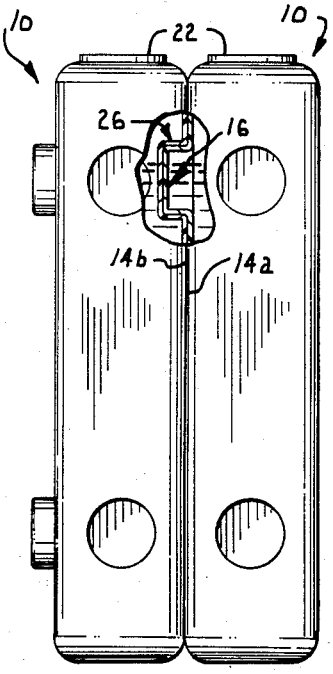
Fig. 4.

CONTAINER FOR FREEZABLE LIQUID

This invention pertains to a container which can be used for refrigerating or temporary cooling purposes when filled with a freezable liquid. More particularly, this invention pertains to such a container which presents a protruding plug on one surface of the container and a complemental recess on an opposite surface so that a plug from one container can be inserted into a recess of another like-constructed container to enable joining of a plurality of such containers together.

It is often desirable to use a container filled with a freezable liquid for cooling or refrigerating rather than using water-ice as the coolant. A common use of such containers is in picnic ice chests, lunch boxes, and other types of storage containers where readily perishable items must be kept cool, such as food or medicines. The use of water-ice in such situations is not preferred because of the pool of water remaining as the water-ice melts. This water can come in contact with the items, such as food, intended to be kept cool and may damage the food but at best is unpleasant and messy. When using water-ice as the coolant, it is therefore usually required that the food, medicines or other items be stored in a sealed watertight bag or container, but if the freezable-liquid is kept in a sealed container, as per this invention, the need for sealed, watertight containers for each food item is obviated. Therefore, the use of a container filled with a freezable liquid avoids the disadvantages of cooling with water-ice in that, when the freezable liquid melts, it remains inside the sealed container. Such containers are known in the prior art. The use of a plurality of such containers is also known, but the prior art does not embody any means for joining together a plurality of such containers which means is an integral part of the container. The prior art shows a plurality of freezable liquid containers joined together by either a connecting bar pivoting on a screw, such as in U.S. Pat. No. 1,716,551, or by a flexible webbing assembly, such as in U.S. Pat. No. 4,311,022. Neither of these methods of joining a plurality of such containers together facilitate stacking the containers on top of each other to form an integrated block of frozen containers. A stack of frozen containers in direct contact with each other offers the advantage of an increased long-term cooling capacity, similar to the cooling effect of block ice, once widely used in refrigerators and other coolers. The primary disadvantage of the prior art is that the containers could not be joined together in such a fashion as to remain integrated in a stack while the storage container they were placed in was being transported or subjected to any vibrational movement.

Another advantage of the present invention is that the containers can be separated, if desired, for individual use or a plurality of individual containers can be strategically placed in the storage container to facilitate quick overall cooling. This ability for individual or separated use gives this invention greater flexibility to the wide variety of possible uses. The containers of the present invention also offer the ability to attach a plurality of containers in a "T" shape to separate the storage container into compartments in any number of sizes. Similarly, the flexibility of this invention is shown when a plurality of these freezable liquid containers are joined together side by side to form a plate of frozen containers for quick cooling over a large surface area.

It is therefore an object of this invention to provide a freezable liquid container which presents means for connecting at least two such containers together in a face-to-face manner to obtain an integrated block of frozen containers to facilitate long periods of cooling. This is accomplished through a container having an integral fastening means molded into the container which will lock multiple containers together in a stacked relationship.

It is another object of this invention to provide a freezable liquid container which presents means for connecting at least two such containers together in a side-by-side manner to form a plate of frozen containers to facilitate quick cooling over a large surface area.

It is a further object of this invention to provide a freezable liquid container with a plug in contra position to the recess on the opposite side of the shell of the container and wherein all such containers are uniformly constructed so that a plurality of containers can readily be joined together to form a variety of configurations to facilitate various individual cooling needs.

It is another object of this invention to provide a freezable liquid container with a shell having the surfaces presenting the plug member and the recess being planar to facilitate direct contact with so joined containers and thereby creating a more efficient and longer lasting cooling mechanism.

BRIEF DESCRIPTION OF THE DRAWINGS

FIG. 1 is a perspective view of the freezable liquid container of the present invention;

FIG. 2 is a side elevational view of the container with a portion broken away to illustrate details of construction;

FIG. 3 is a side elevational view of two containers joined together in a side-by-side manner with a portion of both containers broken away to illustrate the manner of connection;

FIG. 4 is an elevational view of two containers from a different side than FIG. 3, showing the containers fastened together in an alternative position, a portion being broken away to show further details; and FIG. 5 is an enlarged view of the plug and recess illustrating the sidewall and end wall shapes and construction.

DESCRIPTION OF THE SHOWN PREFERRED EMBODIMENT

Referring initially to FIGS. 1 and 2, the container of this invention is designated generally by the numeral 10. Container 10 is generally rectangular and is formed by shell 12 which is constructed of a material which is able to maintain a rigid shape and be adaptable to freezing temperatures, such as plastic. Shell 12 presents two pairs of planar surfaces 14*a*, 14*b* and 15*a*, 15*b*. Planar surface 14*a* is designated as the face of the shell and its complemental surface on the opposite side the back surface. Planar surfaces 15*a* and 15*b* are perpendicular to surfaces 14*a* and 14*b* and are designated the side surfaces of the container. At one end of the shell 12, there are two rounded shoulders 13 which are integral with and merge into end wall 15. End wall 15 has an integral collar 17 which presents an opening 24 for filling the container. Opening 24 is closed by a cap 22 and is sealed shut through use of an adhesive which permanently attaches the cap to collar 17. The adhesive is generally permanent and capable of withstanding freezing temperatures and moist conditions. Container 10 also includes four plugs formed in the planar surfaces of shell 12. All of the plugs are of like shape and function and all are designated generally by the numeral 16. Two of the plugs 16 are presented on face surface 14*a* and two are presented on one of the side surfaces 15*a*. Plugs 16 extend generally perpendicular to their respective planar surfaces and are integral with shell 12. Plugs 16 are of a generally cylindrical configuration and have a sidewall 18 and a planar end surface 20.

Referring to FIG. 2, it is seen that container 10 includes four recesses formed in shell 12 all of which are of like construction and function and are designated generally by the numeral 26. Two of the recesses 26 are located in back surface 14*b* and the other two recesses are located in side surface 15*b*. All recesses 26 are of generally cylindrical configuration having a sidewall 28 and a planar bottom wall 30. Each recess 26 is in contra position to plug 16 on the opposite planar surface of the rectangular shell 12. By being in such contraposition to each other, the plug and the recess are so aligned that they share the same center axis extending in a line perpendicular to planar surfaces 14*a*, 14*b* and through both the recess and the plug. In the broken away portion of FIG. 2, the inner cavity 32 of container 10 is shown and it is seen that this cavity is filled with a freezable liquid 34, such as a plastic gelatin refrigerant which is adapted to repeated freezing and thawing and is generally nontoxic.

Referring to the enlarged view of plug 16 and recess 26 in FIG. 5, the sidewall 28 of recess 26 gradually reduces in diameter as it merges with bottom wall 30 to form a rounded tapered edge and similarly sidewall 18 of plug 16 also reduces in diameter as it meets end surface 20 so that plug 16 and recess 26 fit together in a complemental fashion and facilitate placement of the plug in the recess.

In use, the containers are typically filled with a freezable liquid and sealed shut at the factory, although they may be left empty and filled when needed by the user and sealed shut with a self-sealing screw cap. The filled container is placed in a freezer, usually overnight, so that the freezable liquid is frozen solid. The container, or plurality of such containers, is then ready for use. One such use is shown in FIG. 3 where two such containers 10 are attached in a side-by-side fashion by inserting the plugs 16 of side surface 15*a* into the recesses 26 of side surface 15*b*. The two side surfaces are thereby in direct contact with each other, which facilitates more efficient cooling and this side-by-side configuration allows for quick cooling over a large surface area. This use is beneficial in lining the bottom (or top) of a picnic basket with such containers to keep all items cool.

Another use is illustrated in FIG. 4 where two similarly constructed containers 10 are joined together in a face-to-face manner. These containers were prepared as previously described and illustrate the use of such containers in the form of an ice block to effectuate longer-lasting cooling. Manifestly, more than two containers 10 can be joined together in the same manner to form an even larger ice block for still longer cooling.

We claim:

1. A container for holding freezable liquid, said container comprising:

a plastic shell adapted to receive and contain the freezable liquid, said shell presenting a face surface and an opposed back surface and a pair of opposed side surfaces presenting planar areas smaller than the face and back surfaces;

a pair of spaced apart plugs projecting from said face surface;

a pair of recesses in said back surface in contraposition to and aligned with said plugs and having sizes and shapes complemental to the plugs;

a pair of spaced apart plugs projecting from one of said side surfaces and having the same size, shape and spacing as the plugs on said face surface; and a pair of recesses in the other of said side surfaces in contraposition to and aligned with the plugs on said one side surface and having the same size, shape and spacing as the recesses on said back surface, whereby a plurality of containers can be joined with the plugs on the face surface of each container fitting in the recesses in said back surface or said other side surface of an adjacent container and with the plugs on said one side surface of each container fitting in the recesses in said back surface or said other side surface of an adjacent container, thereby permitting adjacent containers to be arranged face surface against back surface, face surface against side surface, side surface against back surface or side surface against side surface.

* * * * *